US006817559B2

(12) United States Patent
Domlatil et al.

(10) Patent No.: US 6,817,559 B2
(45) Date of Patent: Nov. 16, 2004

(54) DEVICE FOR COMMINUTING A GOOD TO BE COMMINUTED

(75) Inventors: Miroslav Domlatil, Reutlingen (DE); Hans Scheu, Reutlingen (DE)

(73) Assignee: Inotec GmbH Maschinenentwicklung und Vertrieb, Reutlingen (DE)

( * ) Notice: Subject to any disclaimer, the term of this patent is extended or adjusted under 35 U.S.C. 154(b) by 79 days.

(21) Appl. No.: 10/149,868

(22) PCT Filed: Dec. 5, 2000

(86) PCT No.: PCT/EP00/12185

§ 371 (c)(1),
(2), (4) Date: Jun. 13, 2002

(87) PCT Pub. No.: WO01/43878

PCT Pub. Date: Jun. 21, 2001

(65) Prior Publication Data

US 2003/0025016 A1 Feb. 6, 2003

(30) Foreign Application Priority Data

Dec. 15, 1999 (DE) ..... 199 60 409

(51) Int. Cl.[7] ..... B02C 18/30
(52) U.S. Cl. ..... 241/82.5
(58) Field of Search ..... 241/82.5, 82.4

(56) References Cited

U.S. PATENT DOCUMENTS 4,240,591 A * 12/1980 Schnell ..... 241/82.4
6,402,069 B1 * 6/2002 .O slashed.stergaard et al. 241/82.4

FOREIGN PATENT DOCUMENTS

| | | | | |
|---|---|---|---|---|
| CH | 489279 A | * | 6/1970 | |
| DE | 148928 A | * | 6/1981 | ..... B02C/18/30 |
| DE | 3915409 A1 | * | 11/1990 | ..... B02C/18/30 |

* cited by examiner

*Primary Examiner*—Lowell A. Larson
(74) *Attorney, Agent, or Firm*—Bachman & LaPointe, P.C.

(57) ABSTRACT

The invention relates to a device for comminuting a good to be comminuted, in particular in the meat processing industry. The device is provided with cutting assemblies (A, C), each comprising an apertured plate and a rotating cutting head which rotates in front of said plate and which has cutting blades. The cutting assemblies have an adjustable gap between the apertured plate and the cutting blades of the cutting head, respectively. The apertured plates are held against a stop located in a common regulating body. The regulating body is mounted in such a way as to be axially displaceable in relation to the non-displaceable cutting heads, hereby enabling the distance between the apertured plates and the corresponding cutting head to be adjusted simultaneously. At least one other apertured plate is located between the two apertured plates and is supported relative to the adjacent apertured plates by distance rings.

3 Claims, 3 Drawing Sheets

DEVICE FOR COMMINUTING A GOOD TO BE COMMINUTED

BACKGROUND OF THE INVENTION

The invention relates to a device for cutting up a commodity to be cut up, in particular for the meat-processing industry, comprising two cutting sets which in each case consist of a perforated plate and a cutting head rotating in front of said perforated plate and having cutting blades, and have an adjustable gap between the respective perforated plate and the cutting blades of the cutting head, the perforated plates being held against stops inside a common regulating body, which is mounted so as to be axially adjustable relative to the fixed cutting heads and adjusts the perforated plates together in their distance from the associated cutting head.

DE 17 57 274 A discloses a machine for cutting up meat, having a screen body and rotating cutting blades which can be pressed against it by centrifugal force. When the machine is stopped, the blades are lifted from the perforated plate. However, if a shaft for the blade is driven, the blades are pressed against the perforated plate via the centrifugal governor. It is therefore possible to regulate the contact pressure of the blades on the perforated plate by selecting the rotary speed.

Furthermore, CH 489 279 A discloses a cutting-up machine for meat in which three perforated disks are arranged at a distance from one another in a cylindrical housing, the holes of these perforated disks having diameters decreasing with increasing number in the conveying direction of the commodity to be cut up.

A device of the above-mentioned type has been disclosed by DE 39 15 409 A1. This device has considerable advantages as far as the adjustability of the perforated plates and the cutting blades are concerned. As a result, the quality of the cutting-up method is substantially improved.

The object of the present invention is to improve the degree of cutting up and the degree of emulsification of the device and to facilitate the assembly.

SUMMARY OF THE INVENTION

The foregoing is achieved by at least one further cutting set being arranged between the two perforated plates, in which the perforated plate is supported relative to the adjacent perforated plates via distance rings, and at least one distance ring bears against an annular shoulder in the regulating body.

In this case, provision is thus made for the distance rings to be supported against annular shoulders in the regulating body. This means that the distance rings are clamped between these annular shoulders and the clamping rings.

As a result, the assembly of the entire cutting-up region is facilitated.

Furthermore, at least some of the perforated plates are clamped between the distance rings and separate clamping rings. As a result, the securing of the perforated plates can be improved, so that there is no risk of the perforated plates rotating along with the cutting heads.

Due to the use of at least three perforated plates and corresponding cutting heads, the input product can be coarser without influencing the output product. With the same input product, the output product is emulsified in a finer and better manner compared with a two-plate device.

If four or even more plates are used one after the other, the output product can again be improved.

Apart from that, the perforated plates are preferably held against the annular stops from the same side, these annular stops being formed at a predetermined distance apart inside the regulating body.

The present invention also comprises a method of operating an above-mentioned device. It is essential in this case that the gap between perforated plate and cutting head is enlarged (waiting position) when the drive for the cutting head is switched off or is reduced (working position) when the drive starts.

As mentioned above, the cutting head is located on the main motor shaft and is secured there. If the product to be cut up is located in the housing and the cutting head rotates, it presses the product through the perforated plate while cutting it at the same time. In the process, high forces act on the cutting head and thus also on the shaft. These forces cause the shaft to be pushed back.

When the main motor is switched off, the forces emanating from the product to be cut up also decrease and the main motor shaft moves in the opposite direction. This means that the cutting blades and cutting heads are subjected to unnecessary wear every time the machine is switched on and off. For this reason, provision is made for the position of the cutting heads when the main motor is stopped, namely the waiting position, to be different from the working position, when the main motor is running. In the waiting position, the cutting blades maintain a greater distance from the perforated plate than in the working position—shearing position.

BRIEF DESCRIPTION OF THE DRAWINGS

Further advantages, features, and details of the invention follow from the description below of preferred exemplary embodiments and with reference to the drawing, in which.

DETAILED DESCRIPTION

Figure 1:
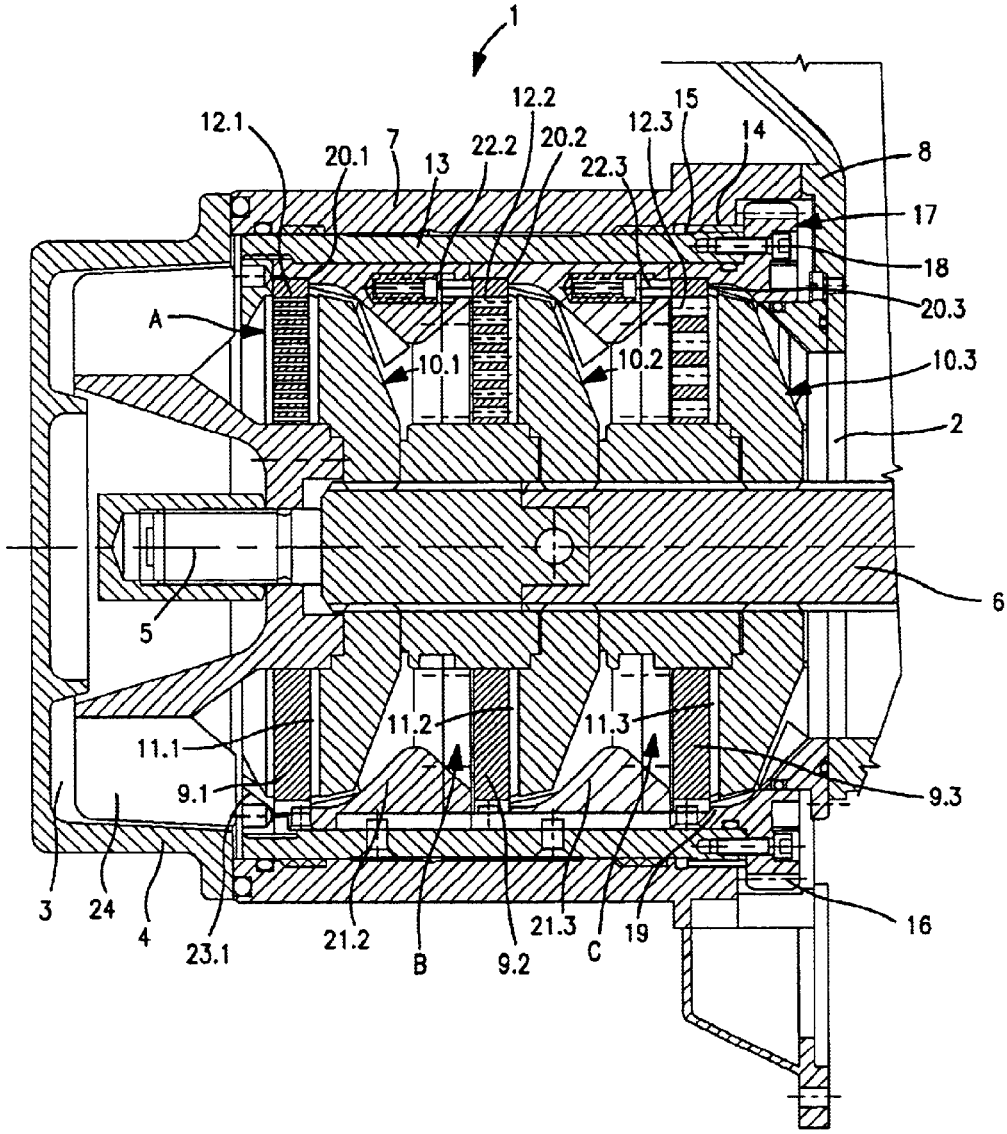
FIG. 1 shows a partial longitudinal section through a cutting-up region of a device according to the invention for cutting up a commodity to be cut up.

According to FIG. 1, of a device for cutting up a commodity to be cut up, for instance of the type disclosed in DE 39 15 409 A1, essentially only a cutting-up region 1 is shown. This cutting-up region 1 has an inlet opening 2 for the material to be cut up and a discharge region 3, which in the present exemplary embodiment is covered by a cap 4.

The commodity to be cut up is conveyed from the inlet opening 2 to the discharge region 3 parallel to a longitudinal axis 5 of a drive shaft 6, the drive shaft 6 projecting through the inlet opening 2 into an approximately cylindrical housing 7, which is connected to an inlet funnel 8 on the one side and is covered by the cap 4 on the other side.

Three cutting sets A, B and C are provided in the housing 7. Each cutting set A, B and C consists of a perforated plate 9.1, 9.2 and 9.3 and of a cutting head 10.1, 10.2 and 10.3 which has cutting blades 11.1, 11.2 and 11.3. The cutting blades 11.1, 11.2 and 11.3 sweep along the perforated plates 9.1, 9.2 and 9.3 or are guided along the perforated plates at a distance equal to approximately zero. Holes 12.3 in the perforated plate 9.3 are larger than holes 12.2 in the perforated plate 9.2. The latter are in turn larger than the holes 12.1 in the perforated plate 9.1.

The cutting heads 10.1 to 10.3 sit on the drive shaft 6 in a rotationally fixed manner and rotate with the drive shaft 6 about the longitudinal axis 5. The perforated plates 9.1 to 9.3, on the other hand, are arranged in a fixed position in a sleeve-shaped regulating body 13. The latter in turn sits in the housing 7, an external-thread section 14 on the regulating body 13 meshing with an internal-thread section 15 on the housing 7. As a result, when the regulating body 13 is rotated, this regulating body 13 can be moved in the direction of the longitudinal axis 5, in the course of which the perforated plates 9.1 to 9.3 are carried along and the distance between each perforated plate and the corresponding cutting blade 11.1 to 11.3 is changed.

The regulating body 13 is preferably rotated via worm gearing (not shown in any more detail) or a stepping motor, on the output shaft of which a corresponding pinion sits, this pinion meshing with a tooth system 16 of a spur gear 17. This spur gear 17 is connected to the regulating body 13 by corresponding screws 18.

In the present exemplary embodiment, an inner flange 19 projects from the spur gear 17 into the regulating body 13 and forms an annular stop 20.3 for the perforated plate 9.3. On the other side, a distance ring 21.3 with spring-loaded thrust pins 22.3 runs against the perforated plate 9.3. These thrust pins 22.3 press the perforated plate 9.3 against the annular stop 20.3 in order to correct a changing perforated-plate thickness.

The distance ring 21.3 in turn forms an annular stop 20.2 for the perforated plate 9.2, which is likewise pressed by spring-loaded thrust pins 22.2 against this annular stop 20.2.

The thrust pins 22.2 are located in a further distance ring 21.2, which in turn forms an annular stop 20.1 for the perforated plate 9.1.

A clamping ring 23.1 screwed into the regulating body 13 then forms the seal for the cutting sets A, B and C.

An ejector 24, covered by the cap 4, sits on the drive shaft 6.

The mode of operation of the present invention is as follows:

A commodity to be cut up, in particular sausage meat, is inserted through the inlet opening 2 and passes into the region of cutting set C. The perforated plate 9.3 is stationary, while the cutting head 10.3 rotates with the drive shaft 6, so that the commodity to be cut is cut up by the cutter blades 11.3 while being pressed into the holes 12.3. Coarse preliminary cutting-up takes place in the holes 12.3 having the largest diameter.

From the cutting set C, the sausage meat passes to the cutting set B having the perforated plate with the holes 12.2 of average diameter. Here, too, the sausage meat is pressed into these holes 12.2 and is at the same time cut up by the cutting blades 11.2 traveling along the perforated plate 9.2.

The commodity to be cut up now passes to the cutting set A, in which the perforated plate 9.1 having the holes 12.1 with the smallest diameter is arranged. Here, too, the sausage meat is pressed into these holes 12.1 and is cut up further by the cutting blades 11.1 when being pressed through.

Finally, the cut-up commodity passes into the ejecting region 3, in which it is fed by the ejector 24 to an ejection opening (not shown in any more detail).

If it is found that the action between cutting blades and perforated plates is no longer optimal, the distance between cutting blades and perforated plates has to be adjusted. To this end, the drive (not shown in any more detail) is put into action, so that, via the tooth system 16, it rotates the spur gear 17 and with the spur gear 17 also the regulating body 13. In the process, the internal thread 15 meshes with the external thread 14, so that the regulating body 13 is moved along the longitudinal axis 5.

Figure 2:
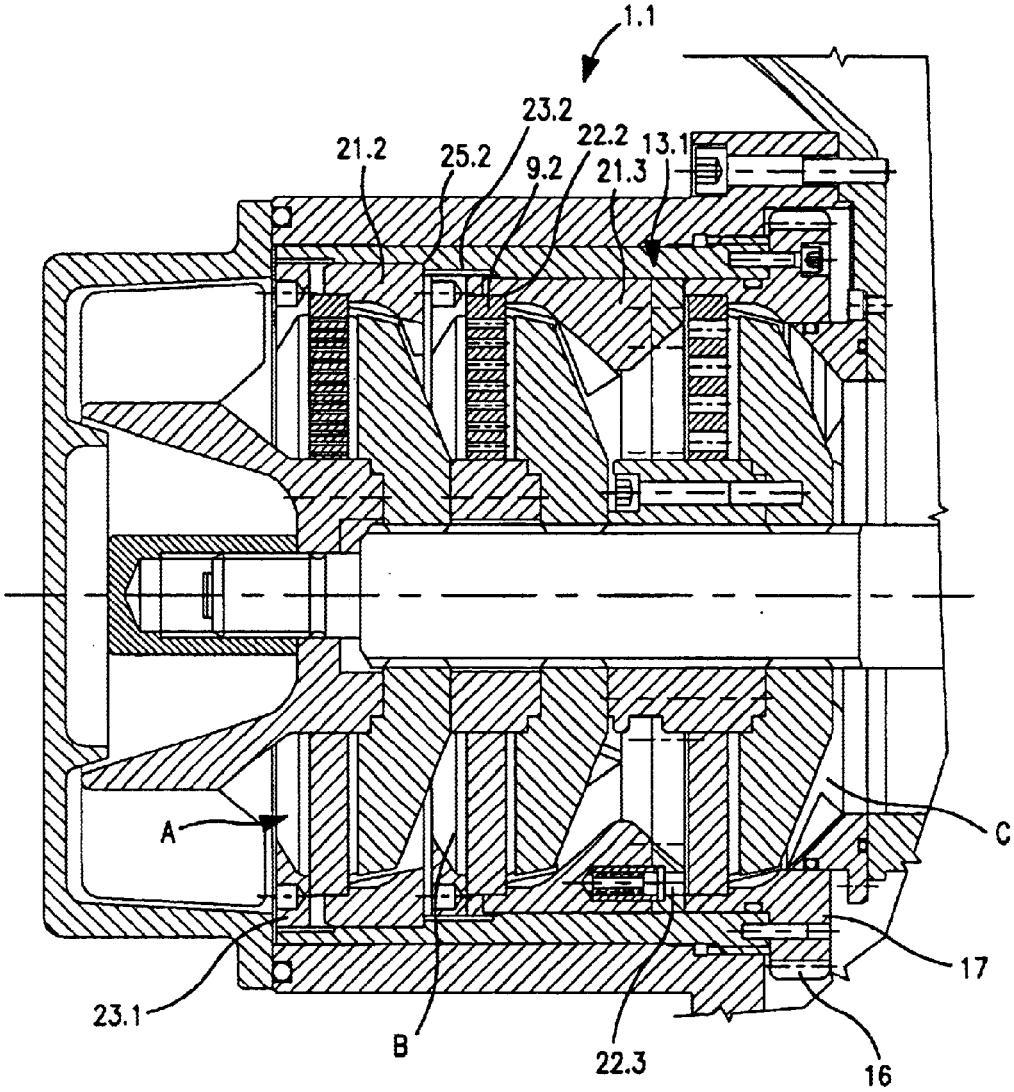
FIGS. 2 and 3 show longitudinal sections through further exemplary embodiments of cutting-up regions of devices according to FIG. 1.

A cutting-up region 1.1 according to FIG. 2 differs from that according to FIG. 1 in that the distance rings have a different configuration and in particular a different diameter. Furthermore, only the distance ring 21.3 has a spring-loaded thrust pin 22.3. The perforated plate 9.2, which sits in the stop 22.2 of the distance ring 21.3, is held in this stop 22.2 by a further clamping ring 23.2 which is screwed into the regulating body 13.1.

The distance ring 21.2 has a larger diameter than the distance ring 21.3 and sits in an annular shoulder 25 which is formed in the regulating body 13.1.

Figure 3:
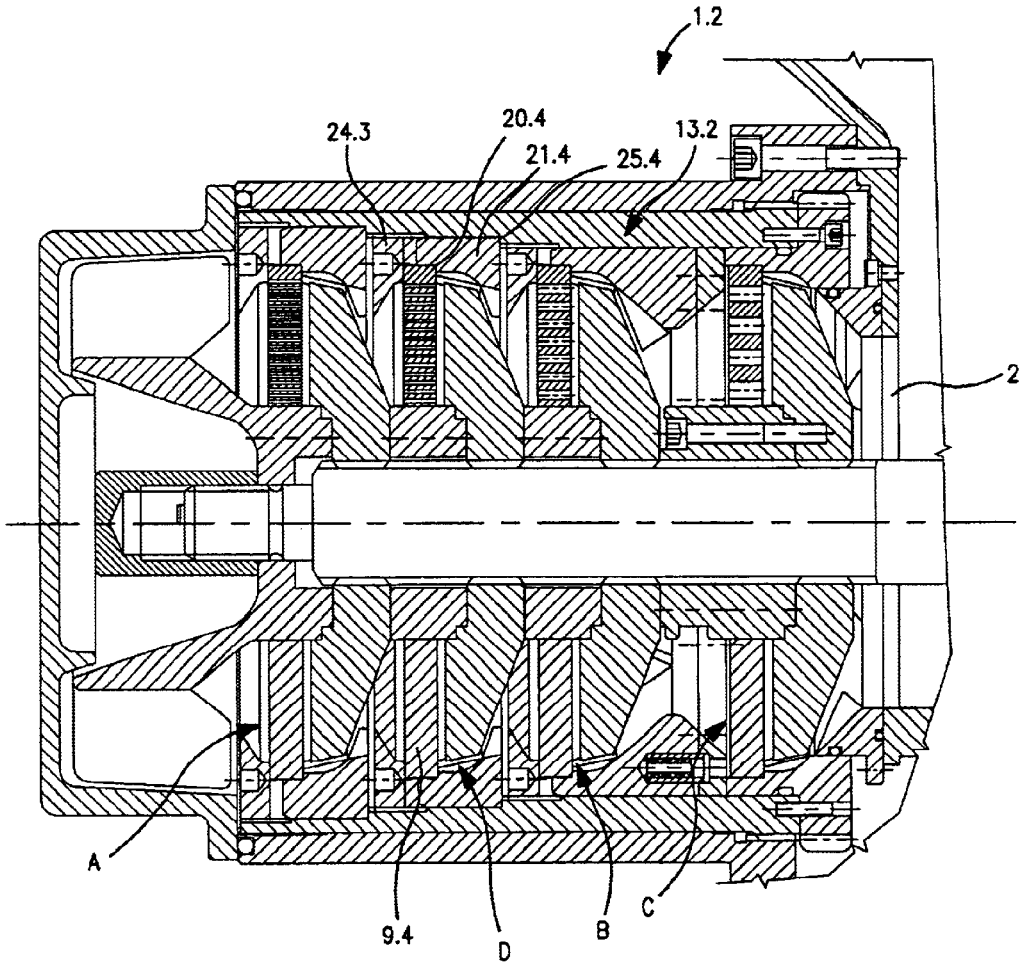

The exemplary embodiment of a cutting-up region 1.2 according to FIG. 3 differs from that according to FIG. 2 in that a further cutting set D is inserted into a regulating body 13.2. This cutting set D has a distance ring 21.4 which in turn forms an annular stop 20.4 for a perforated plate 9.4. The perforated plate 9.4 is held on this annular stop 20.4 by a further clamping ring 23.4. The distance ring 21.4 sits in turn in an annular shoulder 25.4 in the regulating body 13.2.

The cutting set A follows the cutting set D toward the ejection region, and the cutting set B and after that the cutting set C follow the cutting set A toward the inlet opening 2.

What is claimed is:

1. A device for cutting up a commodity comprising a first cutting assembly and a second cutting assembly, each cutting assembly comprises a perforated plate, a stationary cutting head having cutting blades facing the perforated plate, and means for adjusting a gap between the cutting blades and the perforated plate, wherein the perforated plate is retained against a stop member within the adjusting means and is movable axially relative to the stationary cutting head, a third cutting assembly located between the first cutting assembly and the second cutting assembly, the third cutting assembly comprises a third perforated plate and a third cutting head wherein the third perforated plate is supported relative to the perforated plate of the first and second cutting assemblies in a spacer ring which abuts a shoulder which is movable with the adjusting means.

2. The device as claimed in claim 1, wherein the perforated plates of the first and second cutting assemblies are each supported in a spacer ring wherein the spacer rings have different diameters.

3. The device as claimed in claim 2, wherein the third perforated plate is pressed against the shoulder by a thrust pin.

* * * * *